United States Patent [19]

Maruyama et al.

[11] Patent Number: 5,042,274

[45] Date of Patent: Aug. 27, 1991

[54] PIEZOELECTRIC NEEDLE SELECTOR IN A CIRCULAR KNITTING MACHINE

[75] Inventors: Kakuji Maruyama; Kazuhiro Takeuchi; Manabu Banba, all of Bunsui, Japan

[73] Assignee: Nagata Seiki Kabushiki Kaisha, Tokyo, Japan

[21] Appl. No.: 493,208

[22] Filed: Mar. 14, 1990

[30] Foreign Application Priority Data

Mar. 15, 1989 [JP] Japan ..... 1-29631[U]
Mar. 30, 1989 [JP] Japan ..... 1-37213[U]

[51] Int. Cl.[5] ..... D04B 15/78
[52] U.S. Cl. ..... 66/218; 66/221
[58] Field of Search ..... 66/75.2, 218, 219, 220

[56] References Cited

U.S. PATENT DOCUMENTS 3,828,826 8/1974 Hurzeler et al. ..... 66/218 X
3,961,501 6/1976 Martinetz ..... 66/218
3,995,451 12/1976 Vinnemann ..... 66/218
4,875,347 10/1989 Vermot-Gaud et al. ..... 66/219

FOREIGN PATENT DOCUMENTS 210790 2/1987 European Pat. Off. ..... 66/218
1543601 9/1968 France ..... 66/218
1-260044 10/1989 Japan ..... 66/75.2
1270880 4/1972 United Kingdom ..... 66/220

*Primary Examiner*—Wm. Carter Reynolds
*Attorney, Agent, or Firm*—Ladas & Parry

[57] ABSTRACT

A piezoelectric needle selector utilizes an upstanding knitting cylinder having a multiplicity of needle jacks mounted thereto for independent movement in a direction parallel to the axis of the knitting cylinder. A plurality of piezoelectric actuators, each having a stack of planar piezoelectric elements coupled at one end to a plunger, are mounted via respective holders to a fixed support frame disposed adjacent the knitting cylinder. The selective application of voltage pulses to the piezoelectric actuators results in the linear travel of the associated plungers toward and away from the knitting cylinder. The linear travel of the selected plungers is translated into the movement of the desired needle jacks up and down on the knitting cylinder, as by several needle select levers pivoted by the plungers and acting on the usual butts on the needle jacks.

9 Claims, 5 Drawing Sheets

PIEZOELECTRIC NEEDLE SELECTOR IN A CIRCULAR KNITTING MACHINE

BACKGROUND OF THE INVENTION

This invention relates to knitting machines and particularly to circular knitting machines for the production of stockings, socks and like garments, possibly with the capability of creating patterns on the knitwear under electronic control. More particularly, the invention deals with a needle selector utilizing the piezoelectric effect for selectively actuating a multiplicity of needle jacks set on the surface of a knitting cylinder in such knitting machines The piezoelectric needle selector is per se not new in the art and is disclosed in Japanese Laid-Open Utility Model Publication No. 63-167187. This known device includes an upstanding knitting cylinder rotatably mounted on the machine frame and carrying a multiplicity of needle jacks slidably received in as many guideways cut longitudinally in its surface. For selectively lifting the needle jacks on the revolving knitting cylinder, the prior art needle selector employs pairs of piezoelectric actuators or elements each in the shape of a thin strip of piezoelectric material supported in a cantilever fashion. Each pair of piezoelectric elements have pairs of plungers on their free ends for engaging one end of one of several needle select levers which are each medially supported for pivotal movement about a horizontal axis. Each needle select lever terminates at the other end in a finger of extremely hard alloy or ceramic material for acting on a butt of each selected needle jack on the knitting cylinder.

The knitting cylinder with the needle jacks thereon rotates at high speed in the operation of the knitting machine. Electric pulses are impressed to the piezoelectric elements as required by a desired knitting pattern to be created. Each pair of piezoelectric elements deflect by resonance vibration in response to signals of the required resonance frequencies supplied to their anode and cathode. Such resonance vibrations of the piezoelectric elements are imparted via the needle select levers to the needle jacks and hence to the knitting needles, causing the latter to travel up and down on the knitting cylinder. The desired pattern is thus formed on the fabric being knitted The noted prior art device has proved to have certain shortcomings that must be overcome in order to establish true practical utility for the piezoelectric needle selector. First, being made of very thin plates, the piezoelectric elements have been susceptible to destruction due to the repeated application of stresses in use. They have also been unsatisfactory in the length of the stroke over which the needle jacks are moved between the working and retracted positions on the knitting cylinder, and in the force under which they are retained in either position Additionally, due to the lack of response and sufficiently high operating speed, the known needle selector has been prone to chattering, resulting in imperfections in the patterns created.

SUMMARY OF THE INVENTION

The present invention seeks to eliminate all the listed shortcomings of the prior art Briefly, the invention may be summarized as a piezoelectric needle selector in a circular knitting machine, comprising a knitting cylinder having an axis of rotation and having a multiplicity of needle jacks mounted thereto for independent movement in a direction parallel to the axis of the knitting cylinder. In a position radially outward of the knitting cylinder, a plurality of plungers are supported by fixed holder means for independent linear movement toward and away from the knitting cylinder Also supported by the holder means are a plurality of piezoelectric actuators each comprising a horizontal stack of vertically oriented, planar piezoeletric elements which is coupled at one end to one of the plungers. The selective application of a voltage to the piezoelectric actuators results in the linear movement of the associated plungers toward and away from the knitting cylinder. Means are provided for translating the linear movement of the plungers into the movement of the needle jacks on the knitting cylinder.

The improved piezoelectric actuators of this invention, each comprising a multiplicity of planar piezoelectric elements stacked together, are far more durable and less susceptible to destruction than the conventional actuators each consisting of a single thin strip of piezoelectric material. The improved piezoelectric actuators offers the additional advantage of providing a sufficiently long stroke of movement for the needle jacks on the knitting cylinder.

The means for selectively moving the needle jacks up and down on the knitting cylinder in response to the movement of the plungers will be disclosed herein in two primary different forms. Both forms are well calculated to achieve positive and quick needle selection without chattering and without imperfections in the fabric being knitted.

The above and other features and advantages of this invention and the manner of realizing them will become more apparent, and the invention itself will be best understood, from a study of the following description and appended claims, with reference had to the attached drawings showing some preferred embodiments of the invention.

DESCRIPTION OF THE PREFERRED EMBODIMENTS

Figure 1:
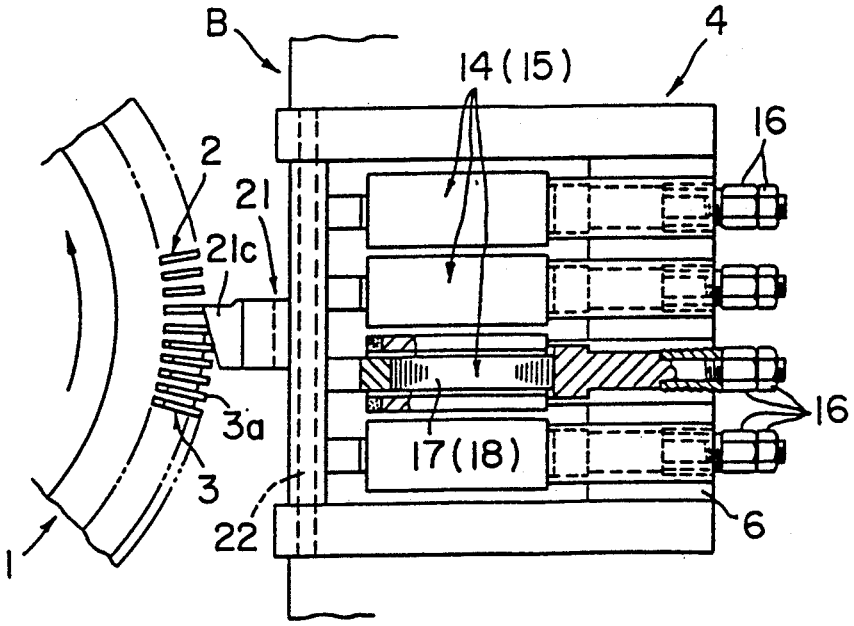
FIG. 1 is a top plan, with parts shown in section for clarity, of the piezoelectric needle selector embodying the principles of this invention.
Figure 2:
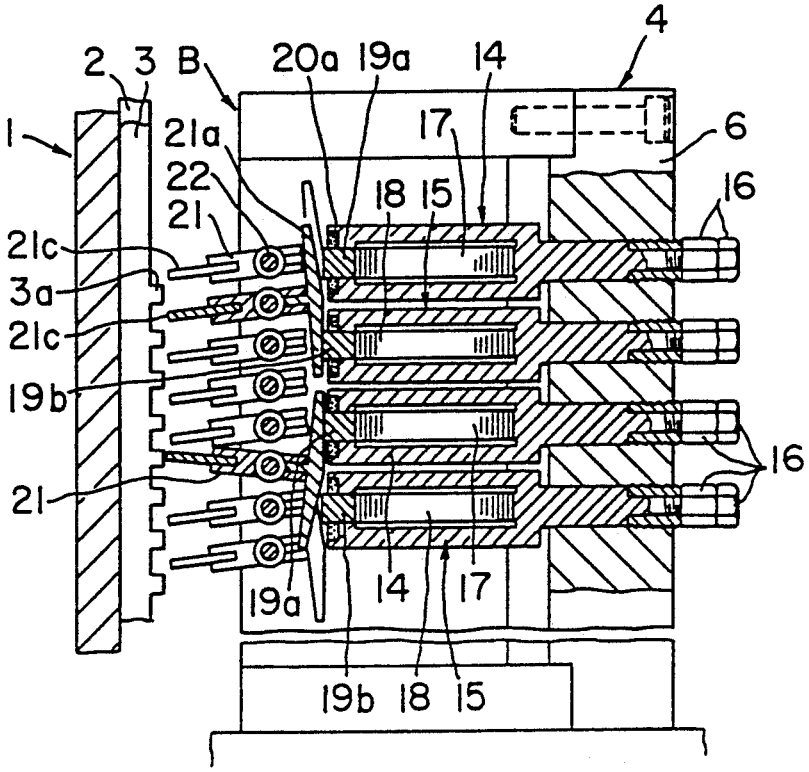
FIG. 2 is a vertical section through the needle selector of FIG. 1.

With reference first and in particular to FIGS. 1 and 2 an upstanding knitting cylinder 1 is mounted on a platform, not shown, of the knitting machine for rotation about its own axis. The knitting cylinder 1 has formed in its surface a multiplicity of groovelike guideways 2 extending parallel to its axis. Slidably received in the guideways 2 are needle jacks 3, with butts 3*a* formed thereon, which are to be selectively moved up and down on the knitting cylinder 1 by means to be set forth hereafter. The up and down movement of the needle jacks 3 results in the same movement of the usual knitting needles, not shown, of the machine.

Figure 3:
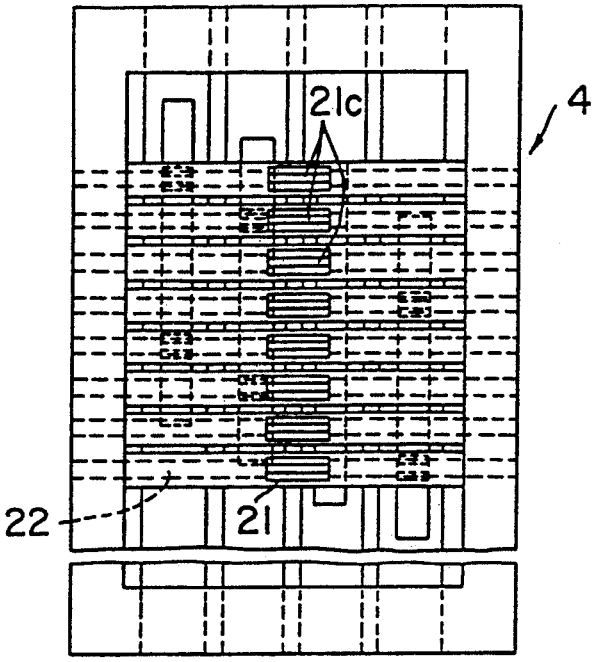
FIG. 3 is a front or left hand end elevation of the needle selector of FIG. 1.
Figure 4:
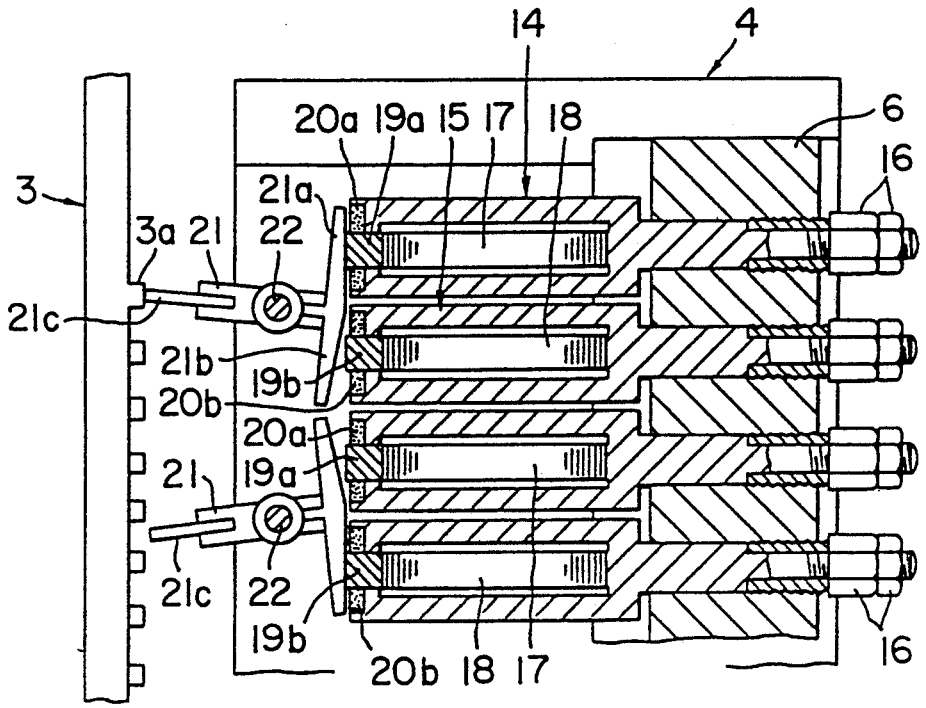
FIG. 4 is a view somewhat similar to FIG. 2 but showing the needle selector on an enlarged scale in order to explain its operation.

As shown also in FIGS. 3 and 4, a generally rectangular support frame 4 is mounted fast on a base B in the immediate vicinity of the knitting cylinder 1 for supporting the various working components of the piezoelectric needle selector. The support frame 4 has a relatively thick backplate 6 to which there are firmly secured in a cantilever fashion a plurality of pairs of upper and lower holders 14 and 15 for pairs of piezoelectric actuators 17 and 18 constituting a feature of the invention. The pairs of actuator holders 14 and 15 extend horizontally in this embodiment or, speaking more broadly, in a direction at right angles with the direction of the axis of rotation of the knitting cylinder 1.

Figure 5:
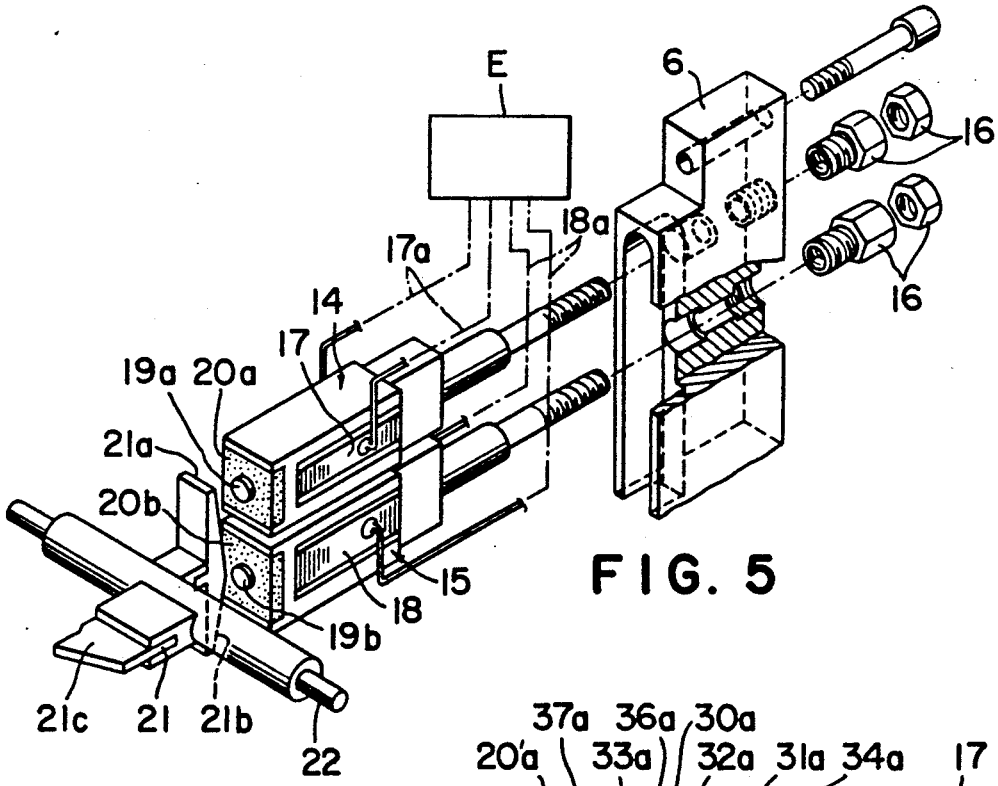
FIG. 5 is an exploded perspective view of one pair of piezoelectric actuators and means associated therewith in the needle selector of FIG. 1.

FIG. 5 shows one such pair of upper and lower actuator holders 14 and 15 together the piezoelectric actuators 17 and 18 housed therein and some other means directly associated therewith. It will be seen from this figure, as well as from FIGS. 1, 2 and 4, that each pair of actuator holders 14 and 15 are adjustably movable relative to the support frame 4 toward and away from the knitting cylinder 1 by the manipulation of adjusting screws 16 on their ends projecting rearwardly of the backplate 6.

The piezoelectric actuators 17 and 18 carried by these actuator holders 14 and 15 are each of laminate construction, comprising a suitable number of vertically oriented, planar piezoelectric elements which are stacked into a horizontally extending pile of required length. An application of voltage pulses to the piezoelectric actuators 17 and 18, through pairs of leads 17*a* and 18*a*, results in instantaneous changes in the longitudinal dimension of the pile, as will be detailed subsequently. The piezoelectric actuators 17 and 18 are controlled by an electronic control system E (FIG. 5).

Coupled to the front ends, oriented toward the knitting cylinder 1, of the piezoelectric actuators 17 and 18 are plungers 19*a* and 19*b* of cylindrical shape which are movable back and forth through guide holes in the front ends of the actuator holders 14 and 15. Each pair of plungers 19*a* and 19*b* are to be thrust forwardly by the associated pair of piezoelectric actuators 17 and 18 into selective abutting engagement with a pair of abutments 21*a* and 21*b* of one associated needle select lever 21 yet to be described. The horizontal positions of the plungers 19*a* and 19*b* with respect to the associated needle select lever 21 are to be adjusted by the adjusting screws 16 for neat contact with the abutments 21*a* and 21*b*.

As will be noted from FIGS. 2, 4 and 5, each pair of actuator holders 14 and 15 have magnets 20*a* and 20*b* of flat, square shape attached to their front ends for attracting the pair of abutments 21*a* and 21*b* of one associated needle select lever 21. It is therefore essential that at least the abutments 21*a* and 21*b* of each needle select lever 21 be made of magnetic material. The magnets 20*a* and 20*b* are centrally bored to permit the plungers 19*a* and 19*b* to loosely or slidably extend therethrough and to project somewhat forwardly of the magnets. Driven by the piezoelectric actuators 17 and 18, each pair of plungers 19*a* and 19*b* are to alternately push the pair of abutments 21*a* and 21*b* of one of the needle select levers 21 through the magnets 20*a* and 20*b*.

Preferably, the plungers 19*a* and 19*b* should project approximately 0.10 to 0.15 millimeter forwardly of the magnets 20*a* and 20*b* when the piezoelectric actuators 17 and 18 are unenergized. Therefore, when attracted to either of the magnets 20*a* and 20*b*, each needle select lever 21 is held spaced as much distance from that magnet. This spacing contributes materially to the quick, positive and chatter-free operation of the needle select levers 21 in response to the pushing action of the plungers 19*a* and 19*b*, as will become better understood as the description proceeds.

FIG. 2 best indicates a plurality of, eight in this embodiment, shafts or pivot pins 22 rigidly supported at the front end of the support frame 4. Each shaft 22 extends horizontally and all the shafts are contained in a vertical plane. Pivotally mounted to these shafts 22 are the noted needle select levers 21 which function to convert the horizontal movement of the plungers 19*a* and 19*b* into the vertical movement of the needle jacks 3 on the knitting cylinder 1 Each in the shape of a recumbent T as seen in a side view as in FIG. 4, the needle select levers 21 have each the pair of abutments 21*a* and 21*b* on its rear end. Each pair of abutments 21*a* and 21*b* are formed at a suitable obtuse angle to each other for neat contact with the pair of plungers 19*a* and 19*b* of one associated pair of piezoelectric actuators 17 and 18. It is thus seen that each needle select lever 21 pivots bidirectionally on one of the shafts 22 as the associated pair of plungers alternately push the pair of abutments 21*a* and 21*b*.

Each needle select lever 21 terminates at the other end in a finger 21*c* of suitable wear resistant material such as ultrahard alloys or ceramics. The fingers 21*c* of the needle select levers 21 selectively engage the butts 3*a* of the needle jacks 3 with the pivotal movement of the needle select levers about the shafts 22.

Operation

The knitting cylinder 1 with the needle jacks 3 thereon rotates at high speed in the direction of the arrow in FIG. 1 during the operation of the circular knitting machine. As stated before, the machine is equipped with the electronic control system E for selectively energizing the piezoelectric actuators 17 and 18 according to a desired design by which the knitwear is to be fashioned. Each selected pair of piezoelectric actuators 17 and 18 are to be alternately energized with electric pulse signals.

Let us assume that a voltage pulse has just been impressed to one piezoelectric actuator 17. Instantaneously translating this electric energy into mechanical energy, the piezoelectric actuator 17 will extend by, say, 20 to 50 micronmeters. The piezoelectric actuator 17 on extension will impulsively thrust the associated plunger 19*a* toward the knitting cylinder 1. So thrust forwardly, the plunger 19*a* will push the abutment 21*a* of the associated needle select lever 21 against the attractive force of the magnet 20*a*. Since the other piezoelectric actuator 18 is now understood to remain unenergized, the needle select lever 21 will pivot counterclockwise, as viewed in FIGS. 2 and 4, about the shaft 22. Thereupon the finger 21*c* of the needle select lever 21 will act on the butt 3*a* of one of the needle jacks 3 on the knitting cylinder 1.

It is self evident from the foregoing that the energization of the other piezoelectric actuator 18 of each pair of such actuators 17 and 18 results in the pivotal movement of the associated needle select lever 21 in a clockwise direction, as viewed in FIGS. 2 and 4. Thus, as the pair of piezoelectric actuators 17 and 18 are selectively activated as required by the preselected knitting design, the needle select levers 21 will selectively act on the desired needle jacks 3, causing them to travel up and down on the knitting cylinder 1.

It is to be appreciated that the piezoelectric actuators 17 and 18 of the improved laminate construction according to the invention instantaneously extend in length in response to voltage pulses. The degree of extension is proportional to the original length to which the constituent elements of each piezoelectric actuator is stacked. Consequently, the piezoelectric actuators can be easily constructed to assure a sufficiently long stroke for the longitudinal movement of the needle jacks 3 between their working and retracted positions. The mechanical energy produced by the piezoelectric actuators 17 and 18 is also far greater than that obtained from the conventional piezoelectric actuators each consisting of a single strip of piezoelectric material. These advantages of the improved piezoelectric actuators according to the invention combine to realize speedy, accurate knitting operation by each desired design.

Another pronounced advantage of the invention resides in the use of the magnets 20*a* and 20*b* in combination with the piezoelectric actuators 17 and 18. These magnets are bored to permit the plungers 19*a* and 19*b* to normally protrude from 0.10 to 0.15 millimeter or so forwardly therethrough. Accordingly, when selectively attracted by the magnets 20*a* and 20*b*, the abutments 21*a* and 21*b* are nevertheless held spaced therefrom, so that the needle select levers 21 can be readily pivoted in either of the opposite directions when the plungers 19*a* and 19*b* are thrust forwardly by the piezoelectric actuators 18 and 19. This quick response of the needle select levers 21 leads to their positive operation without chattering.

Second Form

Figure 5A:
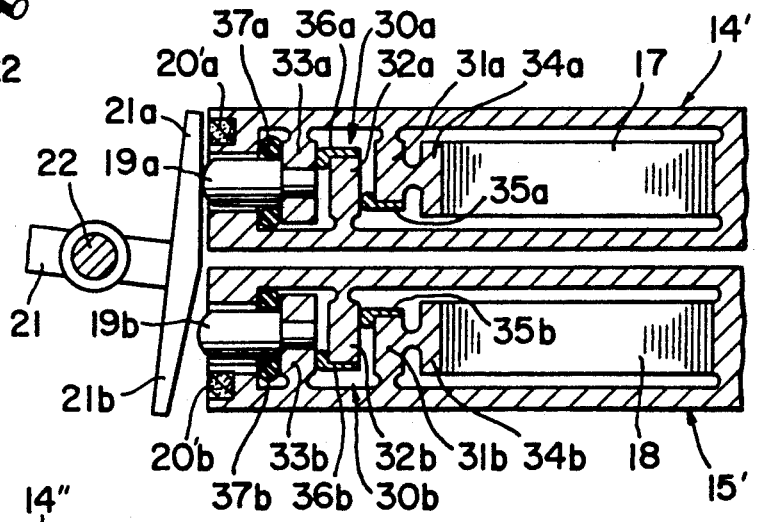
FIG. 5A is a vertical section showing one pair of piezoelectric actuators which are more improved than the piezoelectric actuators shown in FIGS. 4 and 5.

FIG. 5A illustrates a second form of the invention in which means for increasing the stroke of the plungers 19*a* and 19*b* are provided. According to the second form, the actuator holder 14' has therein a movement multiplying device 30*a* between the piezoelectric actuator 17 and the plunger 19*a*, and similarly the actuator holder 15' has therein a movement multiplying device 30*b* between the piezoelectric actuator 18 and the plunger 19*b*.

The movement multiplying device 30*a* comprises a first vertical flexure element 31*a* joined to the upper wall of the holder 14' by way of a thinned portion, a second vertical flexure element 32*a* joined to the lower wall of the holder 14' by way of a thinned portion, and a third vertical flexure element 33*a* joined to the upper wall of the holder 14' by way of a thinned portion. The first flexure element 31*a* has a portion 34*a* integrally joined thereto by way of a thinned portion to abut and hold the front end of the piezoelectric actuator 17. The first flexure element 31*a* fixedly supports on the distal end thereof an abutting piece 35*a* which is in slidable abutting engagement with the second flexure element 32*a*. Similarly, the second flexure element 32*a* fixedly supports on the distal end thereof an abutting piece 36*a* which is in slidable abutting engagement with the third flexure element 33*a*. The rear end of the plunger 19*a* is fitted in the third flexure element 33*a*, and a resilient O-ring 37*a* is disposed between the element 33*a* and the front wall of the holder 14'. The magnet 20'*a* is not of an annular shape in this second form.

The movement multiplying device 30*b* comprises the same elements as described above except that these elements are arranged symmetrically to the elements within the holder 14' with respect to a horizontal plane lying between the two holders 14' and 15'. The equivalent elements within the holder 15 are indicated with the same reference numerals with a subscript b instead of a.

When the piezoelectric actuator 17 is energized and extended, its forward movement causes the first flexure element 31*a* to turn clockwise as viewed, which in turn causes the second flexure element 32*a* to turn counterclockwise by way of the abutting piece 35*a*. In a similar way, the third flexure element 33*a* is turned clockwise by way of the abutting piece 36*a*. Therefore, the plunger 19*a* is thrust forward a distance multiplied by the device 30*a* because the device 30*a* functions to produce a multiplied movement due to its leverage. The O-ring 37*a* serves to push back the flexure elements when the piezoelectric actuator 17 is deenergized. The same function is also obtained by the movement multiplying device 30*b*. It will be understood that the movement multiplying devices 30*a* and 30*b* ensure more rapid and reliable knitting operation than those obtained by the foregoing embodiment.

Third Form

Figure 6:
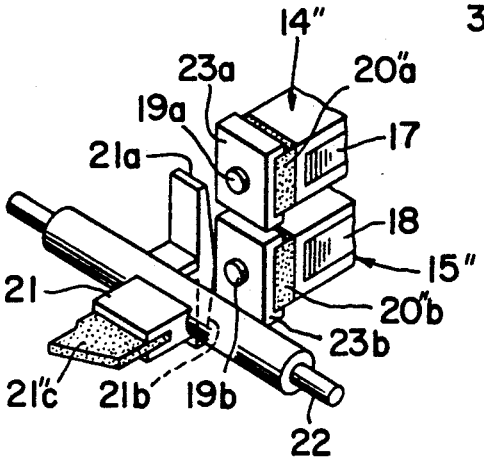
FIG. 6 is a fragmentary perspective view of a slight modification of the embodiment of FIGS. 1 through 5.

FIG. 6 illustrates a slight modification of the embodiment of FIGS. 1 through 5. The modified needle selector features plates 23*a* and 23*b* of soft iron or like magnetic material attached respectively to the front faces of the magnets 20''*a* and 20''*b* on each pair of actuator holders 14'' and 15''. Each pair of magnets 20''*a* and 20''*b* exert their attractive forces on the abutments 21*a* and 21*b* of the associated needle select lever 21 through the magnetic plates 23*a* and 23*b*. The other details of construction are as set forth above in connection with the embodiment of FIGS. 1 through 5.

The magnetic plates 23*a* and 23*b* are intended to mitigate the effects of the magnetic fluxes due to the magnets 20''*a* and 20''*b* on the plungers 19*a* and 19*b* and hence to prevent the rebounding of the abutments 21*a* and 21*b*. Experiment has proved that the magnetic plates 23*a* and 23*b* are effective to assure more positive, chatter free operation of the needle select levers 21.

Fourth Form

FIGS. 7 through 12 illustrate a third preferred form of piezoelectric needle selector according to the invention, from which the needle select levers of the foregoing embodiments are eliminated for greater simplicity in construction and greater reliability in operation.

Figure 7:
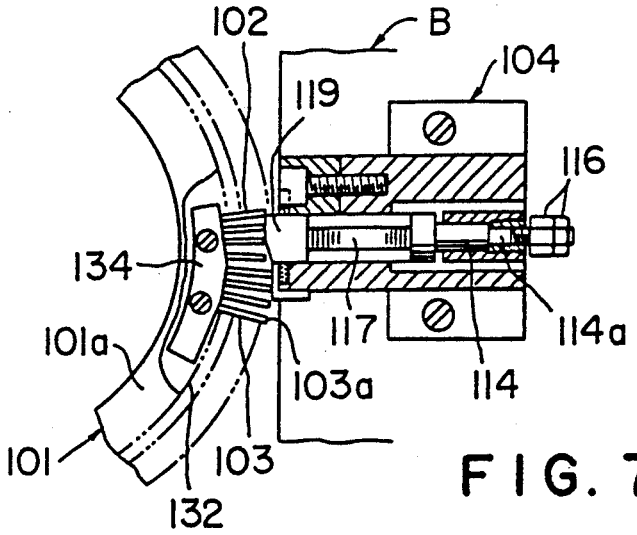
FIG. 7 is a horizontal section through a further preferred form of piezoelectric needle selector according to the invention.
Figure 8:
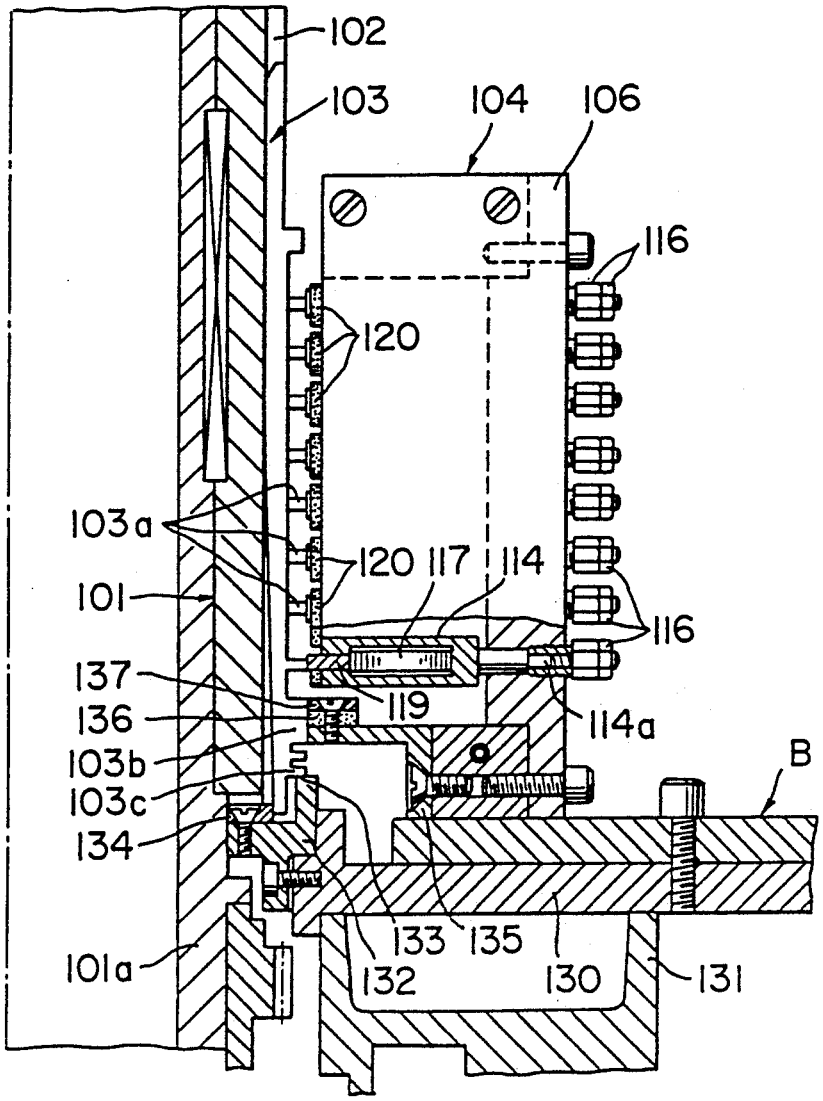
FIG. 8 is an enlarged vertical section through the needle selector of FIG. 7.

As will be noted from FIGS. 7 and 8, the rotatable knitting cylinder 101 of this embodiment has a tube 101*a* mounted concentrically therein. A multiplicity of needle jacks 103, with butts 103*a* thereon, are slidably engaged in respective groovelike guideways 102 defined longitudinally in the surface of the knitting cylinder 101.

Disposed adjacent the knitting cylinder 101 is an elongate support frame 104 immovably mounted on a fixed base B in an upstanding attitude. The support frame 104 supports a series of piezoelectric actuators 117 arranged one on top of another and in opposed relation to the knitting cylinder 101.

Figure 9:
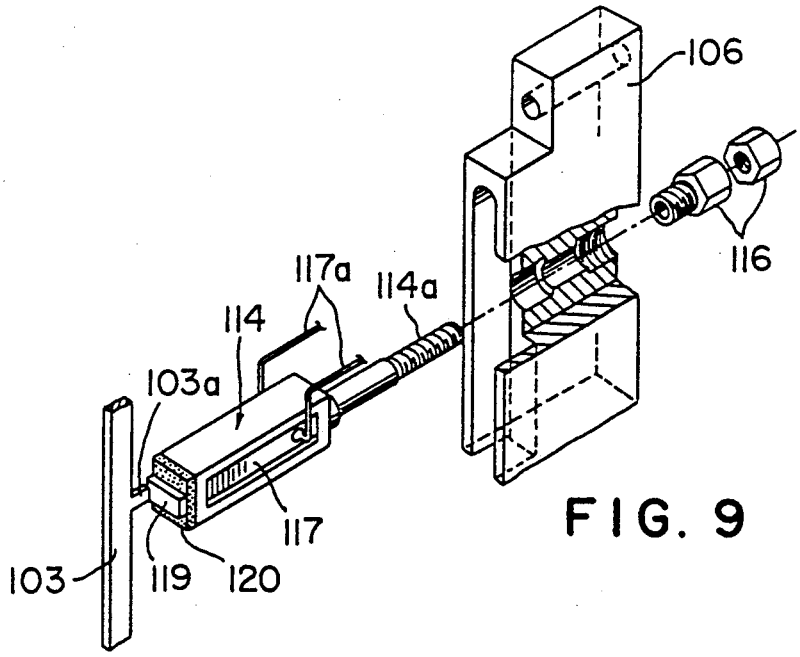
FIG. 9 is an exploded perspective view of one piezoelectric actuator and means associated therewith in the needle selector of FIG. 7.

As will be best understood from a consideration of FIG. 9, the piezoelectric actuators 117 are similar in construction to their counterparts 17 and 18 of the foregoing embodiments, each comprising a stack of planar piezoelectric elements laid horizontally within an actuator holder 114 and provided with a pair of leads 117*a*. All the actuator holders 114 are secured in a cantilever fashion to the backplate 106 of the support frame 104. The horizontal positions of the actuator holders 114 are adjustably variable toward and away from the knitting cylinder 101 by adjusting screws 114*a* extending rearwardly therefrom and nuts 116 thereon.

A plunger 119 is attached to the front end Of each piezoelectric actuator 117 and projects forwardly out of the front end of the associated actuator holder 114. Each shown as a block of wear resisting material for acting directly on the butts 103*a* of the needle jacks 103, the plungers 119 are movable back and forth relative to the actuator holders 114 with the extension and contraction of the piezoelectric actuators 117. Such linear travel of the plungers 119 is guided by the actuator holders 114.

Also as in the foregoing embodiments, each actuator holder 117 has a magnet 120 of flat, square shape attached to its front end. The magnets 120 of this third embodiment act, however, to attract the butts 103*a* of the needle jacks 103 on the knitting cylinder 101. It is therefore essential that the needle jacks 103, or at least the butts 103*a* thereon, be made of magnetic material. The magnets 120 are centrally apertured to permit the plungers 119 to loosely or slidably extend therethrough and to project somewhat forwardly of the magnets. Driven by the piezoelectric actuators 117, the plungers 119 are to push the butts 103*a* of the needle jacks 103 through the magnets 120.

As has also been stated in connection with the embodiment of FIGS. 1 through 5, the plungers 119 should project the preferred distance of 0.10 to 0.15 millimeter forwardly of the magnets 120 when the piezoelectric actuators 117 are unenergized. The needle jack butts 103*a* are therefore to be held spaced as much distance from the magnets 120 by the plungers 119 when attracted by the magnets. This spacing serve to realize the desired quick, positive and chatter-free process of needle selection by the piezoelectric actuators 117.

With reference to FIG. 8 a cam holder 130 is mounted fast under the table B in fixed relation to a table 131. The cam holder 130 rigidly supports on its inside edge an annular cam member 132 concentrically surrounding the knitting cylinder 101.

Figure 10:
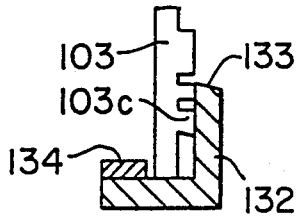
FIG. 10 is an enlarged vertical section of cam means, shown together with one representative needle jack, in the needle selector of FIG. 7.
Figure 11:
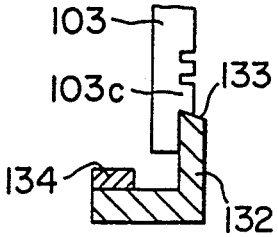
FIG. 11 is a view similar to FIG. 10 except that the representative needle jack shown in a different position on the cam means.
Figure 12:
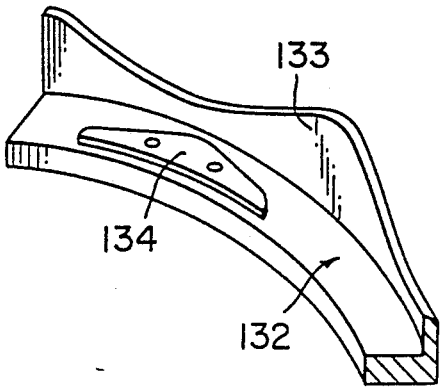
FIG. 12 is an enlarged, fragmentary perspective view of the cam means of FIGS. 10 and 11.

As shown also in FIGS. 10 through 12, the annular cam member 132 has a rim 133 erected along its outer edge. The rim 133 has a contoured top edge for relative sliding engagement with a cam follower butt 103*c* formed in a lowermost position on each needle jack 103. The contoured rim 133 of the cam member 132 serves as a lift cam for lifting the needle jacks 103 on the knitting cylinder 101 upon rotation of the latter.

Mounted fast in a preassigned angular position on the cam member 132 is a push cam 134 of arcuate shape disposed radially inwardly of the lift cam 133. The push cam 134 functions to push the bottom end portions of the successive needle jacks 103 radially outwardly of the knitting cylinder 101. The lift cam 133 lifts the needle jacks 103 as their bottom end portions are pushed out by the push cam 134.

FIG. 8 indicates at 135 an L-shaped member rigidly mounted to the underside of the support frame 104. This L-shaped member has a magnet 136 and a magnetic plate 137 fastened thereto in a position opposite the knitting cylinder 101. The magnet 136 and magnetic plate 137 are for attracting an additional butt 103*b* formed on each needle jack 103 in a position over the cam follower butt 103*c*, thereby aiding in the attraction of the needle jack butts 103*a* by the magnets 120 on the front ends of the actuator holders 114. The magnet 136 and magnetic plate 137 may be omitted if the needle jacks can be smoothly attracted by the magnets 120.

Operation of Fourth

With the high speed rotation of the knitting cylinder 101 in the operation of the circular knitting machine, the needle jacks 103 thereon will have their bottom end portions pushed radially outwardly of the knitting cylinder as they slide over the push cam 134 in a position opposite the vertical stack of piezoelectric actuators 117. The bottom end portions of the successive needle jacks 103 will thus be attracted by the magnets 120 on the front ends of the actuator holders 114 and by the magnet 136 on the L-shaped member 135.

The piezoelectric actuators 117 may be selectively energized according to a desired knitting design. Operating in the same way as their counterparts 17 and 18 of the foregoing embodiments, the piezoelectric actuators 117 on energization will impulsively thrust the plungers 120 toward the knitting cylinder 101 thereby causing the plungers to push the butts 103*a* of the selected needle jacks 103 back into the guideways 102 against the attractive forces of the magnets 120 and 136. The cam follower butts 103*c* of these needle jacks 103 will not ride on the lift cam 133, so that these needle jacks, and therefore the unshown knitting needles associated therewith, will travel past the piezoelectric actuators 117 without being lifted on the knitting cylinder 101.

When not pushed back into the guideways 102 by the plungers 119, on the other hand, the needle jacks 103 will have their cam follower butts 103*c* forced onto the lift cam 133 by the action of both the push cam 134 and the magnets 120 and 136. The needle jacks 103 with the associated knitting needles will then be raised on the knitting cylinder 101. Thus the fabric will be knitted to the desired design by the selective lifting of the knitting needles on the knitting cylinder 101.

This needle selector gains some definite advantages because of the absence of the needle select levers 21 of the foregoing embodiments. A substantial saving in time is realized in the operation of the needle selector as the plungers 119 of the piezoelectric actuators act directly on the butts of the needle jacks. Let us assume that the knitting cylinder 101 carries 400 needle jacks and 400 knitting needles, and that the knitting cylinder rotates at the rate of 400 revolutions per minute. The absence of the needle select levers 21 has proved to result in a saving of time of approximately three milliseconds per needle. This saving of time, combined with the more positive, trouble-free operation of the needle selector, contributes materially to the greater production of the knitting machine.

A further important advantage of this needle selector is that the number of the piezoelectric actuators 117 in use can be reduced to one half of that of the piezoelectric elements 17 and 18 used in the embodiment of FIGS. 1 through 5. The reduction of the number of the piezoelectric actuators accompanies, of course, a corresponding reduction in the numbers of other parts associated therewith.

In this embodiment, too, as in all the other embodiments disclosed herein, the plungers 119 of the piezoelectric actuator 117 extend through the apertured magnets 120 and normally protrude therefrom by 0.10 to 0.15 millimeter or so. Consequently, when attracted directly by these magnets 120, the needle jack butts 103*a* are held spaced as much distance therefrom, so that they can be readily pushed away from the magnets by the plungers 119. The operation of this needle selector is therefore just as positive and chatter free as that of the first described embodiment.

Fifth Form

Figure 13:
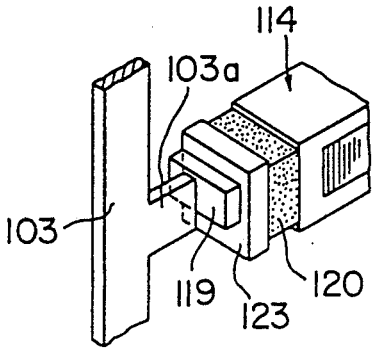
FIG. 13 is a fragmentary perspective view of a slight modification of the embodiment of FIGS. 7 through 12.

FIG. 13 illustrates a slight modification of the embodiment of FIGS. 7 through 12. The modified needle selector has a plate 123 of soft iron or like magnetic material attached to the front face of the magnet 120 on each actuator holder 114, as in the modification of the FIGS. 1 through 5 embodiment illustrated in FIG. 6. Each magnet 120 exert its attractive force on the butt 103*a* of each needle jack 103 through the magnetic plate 123. The other details of construction can be as set forth above in connection with the embodiment of FIGS. 7 through 12. As has been stated with reference to FIG. 6, the magnetic plate 123 serves to mitigate the effects of the magnetic flux due to each magnet 120 on the associated plunger 190 and hence to reduce chattering due to the rebounding of the needle jack butts 103*a*.

It is, of course, understood that various modifications may be made in the details of the above disclosed embodiments in order to conform to the specific requirements of each application of the invention or to design preferences, without departing from the scope of the invention.

What is claimed is:

1. A piezoelectric needle selector in a circular knitting machine, comprising;

(a) a knitting cylinder having an axis of rotation and having a multiplicity of needle jacks mounted thereto for independent movement in a direction parallel to the axis of the knitting cylinder, each of said needle jacks having a butt formed thereon;

(b) holder means immovably supported in a position radially outward of the knitting cylinder;

(c) a plurality of plungers supported by the holder means for independent linear movement toward and away from the knitting cylinder;

(d) a plurality of piezoelectric actuators operatively supported by the holder means and each comprising a stack of planar piezoelectric elements which is coupled at one end to one of the plungers, whereby the selective application of a voltage to the piezoelectric actuators results in the linear movement of the associated plungers toward and away from the knitting cylinder; and (e) means for translating the linear movement of the plungers into the movement of the needle jacks on the knitting cylinder, said translating means comprising:

(f) a plurality of magnets attached to the holder means and each apertured to permit one of the plungers to loosely extend therethrough;

(g) a plurality of needle select levers each medially supported for pivotal movement about an axis extending in a direction at right angles with the direction of the axis of the knitting cylinder;

(h) a pair abutments of magnetic material formed on one end of each needle select lever so as to be alternately attracted by every two magnets, each plunger when moved toward the knitting cylinder pushing one of the abutments away from one associated magnet, so that each needle select lever is pivoted bidirectionally by one pair of piezoelectric actuators; and (i) a finger formed on another end of each needle select lever for operative engagement with the butt of each selected needle jack.

2. The piezoelectric needle selector of claim 1 wherein the plunger project a prescribed distance toward the knitting cylinder out of the apertures in the magnets when the piezoelectric actuators are unenergized, so that the abutments of the needle select levers are held spaced the prescribed distance from the magnets when attracted thereby.

3. The piezoelectric needle selector of claim 1 further comprising a plurality of members of magnetic material attached one to each magnet in order to mitigate the effects of magnetic flux due to the magnets on the plungers.

4. A piezoelectric needle selector in a circular knitting machine, comprising:

(a) a knitting cylinder having an axis of rotation and having a multiplicity of needle jacks mounted thereto for independent movement in a direction parallel to the axis of the knitting cylinder, each of said needle jacks having a butt formed thereon and being of magnetic material;

(b) holder means immovably supported in a position radially outward of the knitting cylinder;

(c) a plurality of plungers supported by the holder means for independent linear movement toward and away from the knitting cylinder;

(d) a plurality of piezoelectric actuators operatively supported by the holder means and each comprising a stack of planar piezoelectric elements which is coupled at one end to one of the plungers, whereby the selective application of a voltage to the piezoelectric actuators results in the linear movement of the associated plungers toward and away from the knitting cylinder; and (e) means for translating the linear movement of the plungers into the movement of the needle jacks on the knitting cylinder, said translating means comprising:

(f) a first cam for causing one end portion of each needle jack to move radially outwardly of the knitting cylinder during the rotation of the latter;

(g) a plurality of magnets attached to the holder means in order to attract the butts of the needle jacks when the end portions of the needle jacks are moved radially outwardly of the knitting cylinder by the first cam, each magnet being apertured to permit one of the plungers to loosely extend therethrough, the plungers when moved toward the knitting cylinder acting directly on the butts of the needle jacks and pushing their end portions back toward the knitting cylinder; and (h) a second cam for causing those needle jacks whose end portions have not been pushed back toward the knitting cylinder, to travel on the knitting cylinder in a predetermined direction parallel to its axis.

5. The piezoelectric needle selector of claim 4 wherein the plunger project a prescribed distance toward the knitting cylinder out of the apertures in the magnets when the piezoelectric actuators are unenergized, so that the abutments of the needle select levers are held spaced the prescribed distance from the magnets when attracted thereby.

6. The piezoelectric needle selector of claim 4 further comprising a plurality of members of magnetic material attached one to each magnet in order to mitigate the effects of magnetic flux due to the magnets on the plungers.

7. The piezoelectric needle selector of claim 1, further comprising movement multiplying means provided between each piezoelectric actuator and each plunger for transforming an extension of the piezoelectric actuator into a multiplied linear movement of the plunger.

8. The piezoelectric needle selector of claim 7, wherein the movement multiplying means comprises cantilever flexure elements extending transversely into the holder means in a mutually parallel arrangement and in alternately opposite directions, said flexure elements being in sliding contact through an abutting piece fixed to a distal end of an adjoining flexure element.

9. The piezoelectric needle selector of claim 8, further comprising a resilient O-ring interposed between the most forward flexure element and a front wall of the holder means.

* * * * *